United States Patent [19]

Fukuchi

[11] Patent Number: 5,052,336

[45] Date of Patent: Oct. 1, 1991

[54] DEVELOPING ROLLER FOR A DEVELOPING UNIT WITH TRANSPORT, DEVELOP AND COLLECT MAGNETS

[75] Inventor: Yutaka Fukuchi, Tokyo, Japan

[73] Assignee: Ricoh Company, Ltd., Tokyo, Japan

[21] Appl. No.: 570,330

[22] Filed: Aug. 21, 1990

[30] Foreign Application Priority Data

Aug. 26, 1989 [JP] Japan ..... 1-99535[U]

[51] Int. Cl.[5] ..... G03G 15/09

[52] U.S. Cl. ..... 118/658; 355/251; 355/253

[58] Field of Search ..... 355/251, 253, 259, 245; 118/657, 658

[56] References Cited

U.S. PATENT DOCUMENTS

| | | | |
|---|---|---|---|
| 3,626,898 | 12/1971 | Gawron | 118/658 |
| 3,977,361 | 8/1976 | Nagashima et al. | 118/658 |
| 4,679,527 | 7/1987 | Chang | 118/658 |
| 4,806,971 | 2/1989 | Masham | 118/658 X |

FOREIGN PATENT DOCUMENTS

| | | | |
|---|---|---|---|
| 2420085 | 4/1974 | Fed. Rep. of Germany | 118/658 |

*Primary Examiner*—A. T. Grimley
*Assistant Examiner*—Christopher Horgan
*Attorney, Agent, or Firm*—Oblon, Spivak, McClelland, Maier & Neustadt

[57] ABSTRACT

A developing roller for a developing unit of an image forming apparatus has at least a magnet with a transport pole, a magnet with a develop pole, and a magnet with a collect pole. These magnets are accommodated in a rotary sleeve and affixed to a support member. The magnet with the develop pole is dimensioned longer than the other magnets as measured in the axial direction of the roller. The developing roller surely collects a developer of a magnet brush remaining on the roller after development, and thereby frees the interior of the apparatus from contamination ascribable to the developer.

6 Claims, 4 Drawing Sheets

DEVELOPING ROLLER FOR A DEVELOPING UNIT WITH TRANSPORT, DEVELOP AND COLLECT MAGNETS

BACKGROUND OF THE INVENTION

The present invention generally relates to a developing unit for an image forming apparatus implemented with an electrophotographic procedure and, more particularly, to an improvement in a developing roller included in the developing unit.

An electrophotographic copier, facsimile transceiver, printer or similar electrophotographic image forming apparatus has a developing unit for developing a latent image electrostatically formed on a photoconductive element. The developing unit has a casing loaded with a developer and a developing roller which transports the developer to the photoconductive element to develop the latent image as mentioned above. The developing unit is operable with a one-component developer or a two-component developer, as desired. The one-component developer is a magnetic toner and void of a carrier, while the two-component developer is a mixture of a non-magnetic or weakly magnetic toner and a magnetic carrier. The two-component developer is predominant over the one-component developer since it promotes easy control over the frictional charging of the toner and has desirable developing ability.

The developing roller has a rotary sleeve and a plurality of magnets which are so arranged in the sleeve as to face the inner wall of the sleeve. The magnets generate magnetic fields on the outer periphery of the sleeve to cause the developer to form a so-called magnet brush on the sleeve. The magnet brush constituted by the developer rises toward the photoconductive element with the result that the toner is electrostatically adhered to the latent image formed on the photoconductive element, thereby turning the latent image into a toner image.

The magnet brush is formed along the individual magnetic lines of force of the magnetic fields developed on the sleeve. Hence, the magnet brush rises substantially vertically from the central area of the pole-face of each magnet, but it begins to incline outward as it approaches the edges of the pole-face. The inclination sharply increases at the outside of the edge portions. Further, the magnet brush is inclined at axially opposite end portions of the sleeve in such a manner as to bulge out in the axial direction beyond the opposite end portions.

The magnets are arranged such that their poles alternate with each other. While the magnet brush is transported by the sleeve, it is effected by such magnets. The magnet securely positioned in the sleeve downstream of the others with respect to the transporting direction, i.e. a magnet having a collect pole removes the magnet brush remaining on the sleeve and collects it into the developing unit. However, the magnet brush is inclined outward at the axially opposite end portions of the sleeve, as mentioned above. The magnet brush, therefore, cannot be fully collected in the developing unit and is apt to fall into the interior of the image forming apparatus to thereby contaminate it.

SUMMARY OF THE INVENTION

It is therefore an object of the present invention to provide a developing roller for a developing unit which surely collects into the unit the developer of a magnet brush remaining on the surface of the roller after development.

It is another object of the present invention to provide a developing roller for a developing unit which frees the interior of an image forming apparatus from contamination otherwise caused by a developer leaking from the unit.

It is another object of the present invention to provide a generally improved developing roller for a developing unit.

A developing roller for a developing unit which develops a latent image electrostatically formed on an image carrier of an image forming apparatus by using a magnet brush constituted by a developer of the present invention comprises a rotary sleeve for forming the magnet brush on a surface thereof and transporting the magnet brush to the image carrier carrying the latent image, a transport magnet accommodated in the sleeve and comprising a transport pole, a develop magnet accommodated in the sleeve and located downstream of the transport magnet with respect to an intended direction of rotation of the sleeve in such a manner as to face the latent image carried on the image carrier, and comprising a develop pole, a collect magnet accommodated in the sleeve and located in a position downstream of the develop magnet with respect to the above direction and comprising a collect pole for collecting the developer of the magnet brush remaining on the sleeve into the developing unit, and a support member accommodated in the sleeve for securely supporting the transport magnet, develop magnet, and collect magnet. The collect magnet is dimensioned longer than the transport magnet and develop magnet as measured in the axial direction of the sleeve.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
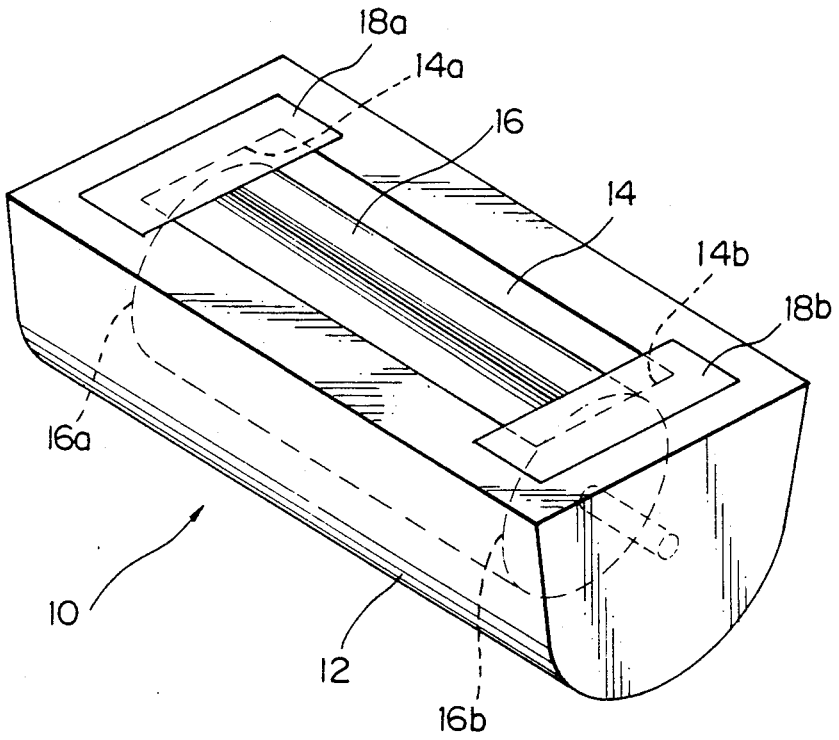
Fig. 1 PRIOR ART
FIG. 1 is a perspective view of a developing unit having a prior art developing roller.

To better understand the present invention, a brief reference will be made to a prior art developing unit having a developing roller, shown in FIG. 1. The developing unit shown in FIG. 1 is elaborated to eliminate the problem of the conventional developing unit discussed previously. Specifically, in the conventional developing unit, a magnet brush formed on a rotary sleeve of a developing roller is inclined at opposite end portions of and along the axis of rotation of the sleeve in such a manner as to bulge out beyond the opposite ends of the sleeve. In this condition, a magnet fixed in place in the sleeve and having a magnet cannot remove and collect the magnet brush into the developing unit alone, so that the developer is scattered around to contaminate the interior of the image forming apparatus.

In FIG. 1, the prior art developing unit, generally 10 has a casing 12 provided with an opening 14, and a developing roller 16 accommodated in the casing 12. Elastic seal members 18*a* and 18*b* are adhered to the casing 14 at opposite ends, 14*a*, 14*b* of the opening 14 which face respectively opposite ends 16*a* and 16*b* of the roller 16. The seal members 18*a* and 18*b* are implemented as urethane blades, polyester films, or pieces of synthetic leather, for example. Although the seal members 18*a* and 18*b* may intercept a developer tending to run out of the casing 12 at the opposite ends 16*a* and 16*b* of the roller 16, the interception is not satisfactory since they do not positively or directly remove the developer at the ends 16*a* and 16*b*. The prior art developing unit 10, therefore, cannot fully collect the developer into the casing 12 and causes it to smear the interior of an image forming apparatus in which the developing unit 10 is incorporated. While an agitator, not shown, accommodated in the developing unit 10 agitates the developer, the seal members 18*a* and 18*b* may effectively prevent the developer from being scattered around.

Figure 2:
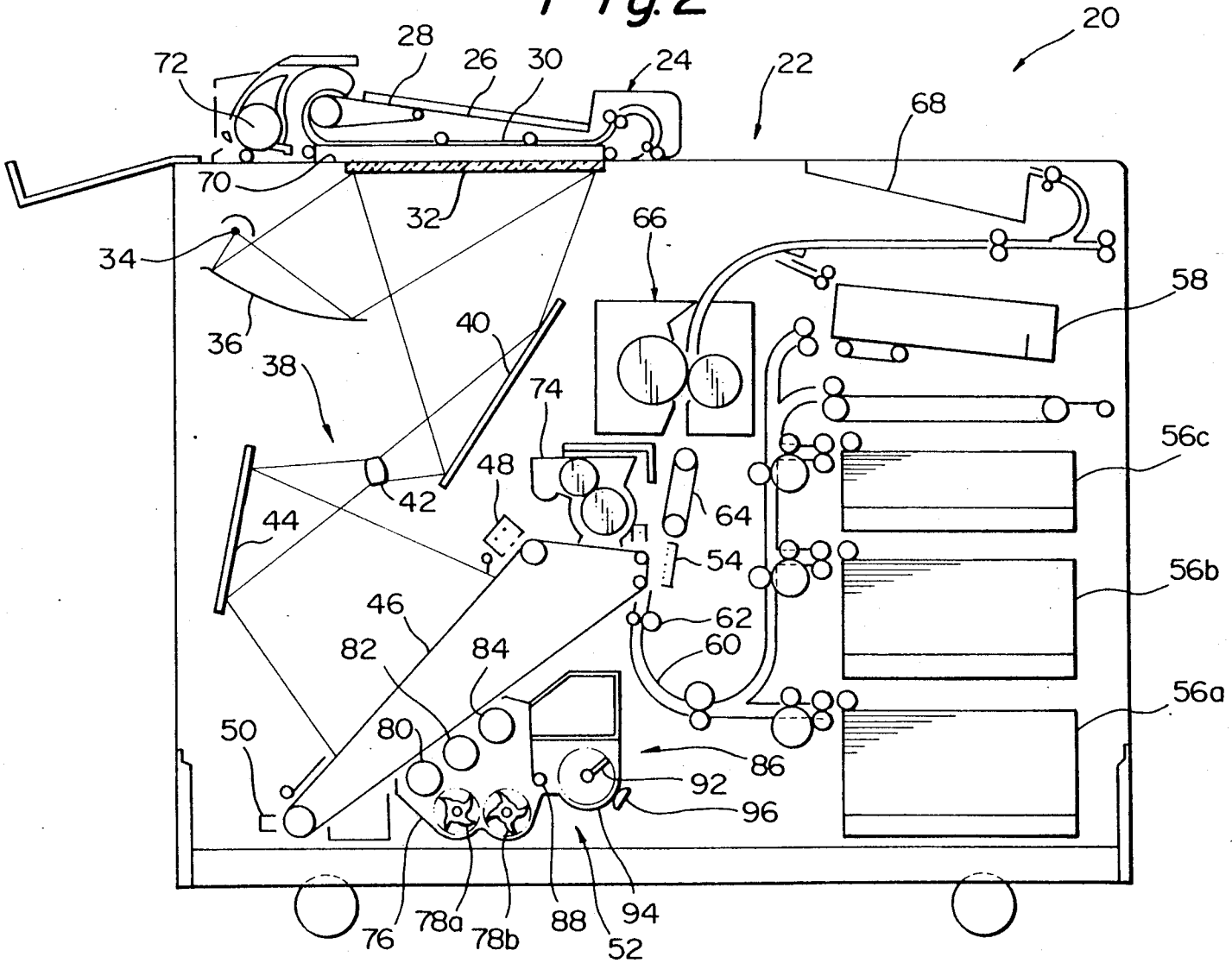
FIG. 2 is a section showing an image forming apparatus having a developing unit to which the present invention is applicable and implemented as an electrophotographic copier.

Referring to FIG. 2, an electrophotographic copier belonging to a family of image forming apparatuses to which the present invention is applicable is shown. The copier, generally 20, has a copier body 22 and an ADF (Automatic Document Feeder) 24. After desired copying conditions have been entered on an operation board provided on the copier body 22, a print button is pressed to cause the copier into a copying operation. The ADF 24 has a document tray 26 on which documents are stacked face down. A document feed belt 28 feeds the documents one by one toward a glass platen 32 along a transport path 30. As the document arrives at the glass platen 32, a lamp 34 is turned on. Light issuing from the lamp 34 is reflected by a mirror 34 to illuminate the entire surface of the document over a predetermined period of time. The resultant reflection from the document is propagated through an optical system 38 having a first mirror 40, a lens 42, and a second mirror 44, whereby a photoconductive belt 46 is exposed imagewise. The photoconductive belt 46 is moved in a direction indicated by an arrow X in the figure.

The photoconductive belt 46 is uniformly charged by a main charger 48 beforehand, so that a latent image is electrostatically formed on the belt 46 by the imagewise exposure. After an eraser 50 has dissipated the charge from needless areas of the belt 46, the latent image is developed by a developing unit 52. The developed image, or toner image, is transferred to a paper sheet at an image transfer station. Specifically, the paper sheet is fed from any one of paper trays 56*a*, 56*b* and 56*c* or from an intermediate or two-side tray 58 and, in synchronism with the toner image, driven toward the transfer station by a register roller pair along a paper transport path 60. The paper sheet carrying the toner image thereon is transported by a transport belt 64 to a fixing unit 66, whereby the toner image is fixed on the paper sheet. Thereafter, the paper sheet is driven out to a copy tray 68. On the other hand, the document on the glass platen 32 is driven out by a transport belt 70 on the completion of the imagewise exposure. The document is transferred from the belt 70 to a discharge roller 72 and thereby returned to the document tray 26. A cleaning unit 74 removes the charge and toner particles which remain on the photoconductive belt 46 after the image transfer. Then, the main charger 48 again charges the belt 46 to prepare the latter for another imagewise exposure.

The developing unit 52 has a casing 76 which stores a two-component developer, i.e., a mixture of toner and carrier or a one-component developer, i.e., a magnetic toner. Agitators 78*a* and 78*b* are disposed in the casing 76 and driven to agigate the developer, thereby maintaining it in a uniform distribution. The developer is fed to and carried on developing rollers 80, 82 and 84. The toner of the developer carried on each developing roller 80, 82 or 84 is electrostatically adhered to a latent image formed on the photoconductive belt 46 to thereby turn it into a toner image. As the copying operation is repeated, the toner in the casing 76 is sequentially consumed. As a result, the ratio of the toner to the carrier, i.e., toner concentration (or the amount of toner) is reduced little by little. The decrease in the toner concentration (or the amount of toner) is sensed in terms of, for example, a change in the electric resistance of the developer (or the required torque of the agitators 78*a* and 78*b*). In response, a toner supply roller 88 supplies a fresh toner, a predetermined amount at a time, from a toner supply device which is associated with the developing unit 52. This is successful in maintaining the toner concentration (or the amount of toner) in the casing 76 in a predetermined range.

A toner cartridge 90 is removably mounted on the toner supply device 86 to supply the fresh toner to the device 86. The toner supply device 86 has a casing 94 in which an agitating bar 92 is accommodated. The bar 92 agitates the toner in the casing 94 as needed, so that the toner may not form masses and, especially, it may be uniformly distributed along the axis of the developing rollers 80, 82 and 84. A piezoelectric sensor 96 is affixed to a part of a wall of the casing 94 for sensing the amount of toner remaining in the toner supply device 86. When the sensor 96 senses that the amount of toner remaining in the device 86 has become smaller than a predetermined amount, a warning such as a message "TONER END (or TONER NEAR END)" appear on the operation board of the copier body 22. The warning urges the operator to open a cover of the copier body 22 and replace the toner cartridge 90.

Figure 3:
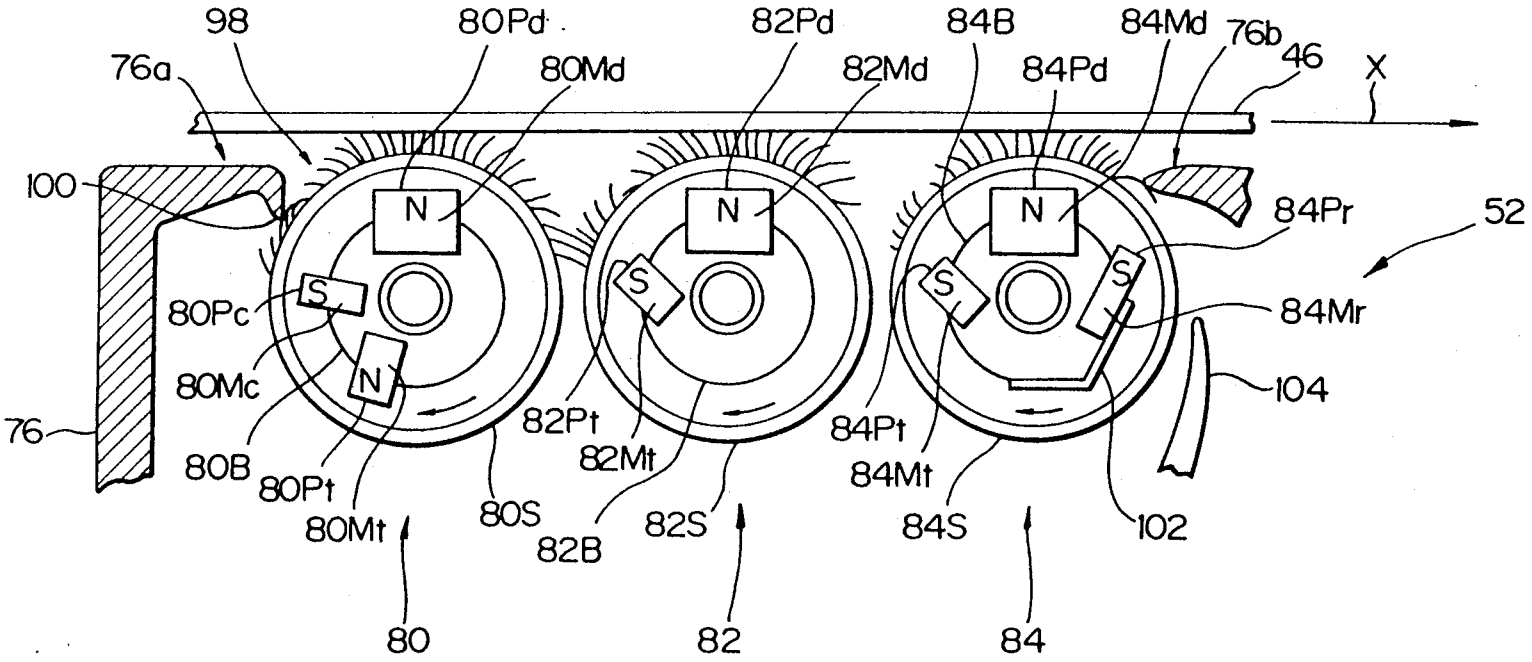
FIG. 3 is a sectional side elevation showing a specific construction of the developing unit shown in FIG. 2.

FIG. 3 shows the three developing rollers 80, 82 and 84 of the developing unit 52 more specifically. As shown, the developing rollers 80, 82 and 84 are sequentially arranged in this sequence in the moving direction of the photoconductive belt 46. The rollers 80, 82 and 84 have respectively rotary sleeves 80S, 82S and 84S, and support members 80B, 82B and 84B accommodated in the sleeves 80S, 82S and 84S, respectively. The support members 80B, 82B and 84B each is loaded with a plurality of permanent magnets which are different in polarity from one another. Specifically, in the developing roller 80 located at the upstream side, a magnet 80M*t* having a transport pole 80P*t*, a magnet 80M*c* having a transport restrict pole 80P*c*, a magnet 80M*d* having a develop pole 80P*d* are mounted on the support member 80B inside of the associates sleeve 80S. In the intermediate developing roller 82, a magnet 82M*t* having a transport pole 82P*t* and a magnet 82M*d* having a develop pole 82P*d* are mounted on the support member 82B inside of the sleeve 82S. Further, in the developing roller 84 located at the downstream side, a magnet 84M*t* having a transport pole 84P*t*, a magnet 84M*d* having a develop pole 84P*d*, and a magnet 84M*r* having a collect pole 84P*r* are mounted on the support member 84B inside of the associated sleeve 84S.

In operation, the developer deposited on the surface of the sleeve 80S of the developing roller 80 by the transport pole 80P*t* is transported to the position where the transport restrict pole 80P*c* is located, as the sleeve 80S is rotated as indicated by an arrow in FIG. 3. While being adhered to the surface of the sleeve 80S by the restrict pole 80P*c*, the developer is regulated to a predetermined thickness by a doctor 100. The doctor 100 forms one edge 76*a* of the casing 76 which defines an opening 98 in cooperation with the other edges. On entering the magnetic field of the develop pole 80P*d*, the developer having the regulated thickness is caused to rise in a brush configuration and thereby contacts the surface of the photoconductive belt 46. Nevertheless, the toner once deposited on a latent image formed on the belt 46 is prevented from being rubbed off by the belt 46 since the sleeve 80B and the belt 46 are moving at the same speed and in the same direction. The developer moved away from the develop pole 80P*d* is brought out of contact with the belt 46 and, instead, adhered to the surface of the sleeve 82S of the developing roller 82 by the transport pole 82P*t*. The developer transferred from the sleeve 80S to the sleeve 82S is brought to the position where the develop pole 82P*d* is located, due to the rotation of the sleeve 82. Then, the developer again rises in a brush configuration to develop a non-developed portion of the latent image.

Thereafter, the developer is transferred from the sleeve 82S to the sleeve 84S by the transport pole 84P*t* accommodated in the developing roller 84. As a result, the developer again develops the latent image under the action of the develop pole 84P*d* to thereby fully transform the latent image into a toner image. The developer moved away from the develop pole 84P*d* is attracted by the collect pole 84P*r*. Consequently, the developer is caused to fall down on the surface of the sleeve 84S by the magnetic field being developed by the develop pole 84P*d* and collect pole 84P*r*. This part of the developer, therefore, moves through the clearance between the sleeve 84S and another edge 76*b* of the opening 98 which faces the previously mentioned edge 76*a* into the casing 76 of the developing unit 52. A shield plate 102 is located in close proximity to the collect pole 84P*r* to weaken the magnetic field of the pole 84P*r*. As a result, the developer collected in the casing 76 is separated from the sleeve 84S and then distributed in two different directions by a separator 104.

Figure 4:
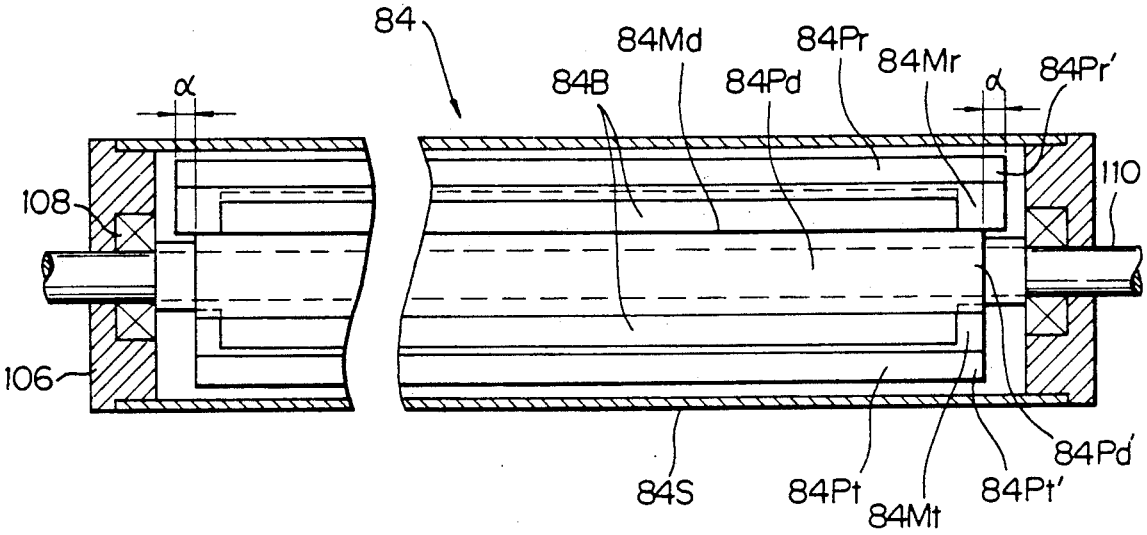
FIG. 4 is a plan view showing, among developing rollers shown in FIG. 3, a developing roller provided with a magnet having a collect pole.

FIG. 4 is a section showing the sleeve 84S, sides plates 106 for support, and bearings 108 which are included in the downstream developing roller 84, FIG. 3. As shown, the sleeve 84S is implemented as a thin and long hollow cylinder which is made of a non-magnetic material. The magnetic fields developed by the individual poles, therefore, are easy to permeate the sleeve 84S without being disturbed by the latter. Narrow axial grooves extend on the surface of the sleeve 84S to promote the transport of the developer, although not shown in the figure. The side plates 106 are also made of a non-magnetic material and press-fitted in opposite ends of the sleeve 84S. The bearings 108 are each embedded in respective side plates 106. The support member 84B is also made of a non-magnetic material and formed with axially extending slots at circumferentially spaced locations. Securely received in the slots are the magnets 84M*t*, 84M*d* and 84M*r*. The transport pole 84P*t* of the magnet 84M*t*, the develop pole 84P*d* of the magnet 84M*d*, and the collect pole 84P*r* of the magnet 84M*r* are implemented as the S pole, N pole, and S pole, respectively. Further, the shield plate 102 is affixed to the support member 84B in contact with the side surface of the magnet 84M*r*. A stationary shaft 110 extends throughout the support member 84B along the axis of the latter. The side plates 106 and sleeve 84S are rotatably mounted on the shaft 110 through the bearings 108. The stationary shaft 110 is affixed to the copier body 22 in such a position that the poles 84P*t*, 84P*d* and 84P*r* assume adequate positions relative to the photoconductive belt 46. The sleeve 84S is driven in a rotary motion about the stationary shaft 110.

As shown in FIG. 4, the magnet 84M*r* having the collect pole 84P*r* is longer than the magnets 84M*t* and 84M*d*, i.e., the former extends out by a distance a beyond the latter at opposite ends of thereof. The brush magnetically formed on the sleeve 84S by the poles 84P*t* and 84P*d* rises substantially vertically in most of the portions above the poles 84P*t* and 84P*d*, but it is inclined outward in opposite end portions 84P*t*′ and 84P*d*′ of the magnets 84 P*t* and 84P*d*, as stated earlier. This is why the prior art developing unit fails to collect the developer residing in the opposite end portions 84P*t*′ and 84P*d*′ sufficiently. In contrast, in the illustrative embodiment, the magnet 84M*r* with the collect pole 84P*r* is dimensioned longer than the magnets with the poles 84P*t* and 84P*d*, particularly the magnet 84M*d* with the develop pole 84P*d*. More specifically, the opposite ends 84P*r*′ of the magnet 84M*r* are positioned axially outward of the opposite ends of the other magnets. The collect pole 84P*r* having such a configuration surely attracts and thereby collects even the developer residing in the opposite inclined portions of the magnet brush.

While the illustrative embodiment has been shown and described in relation to three developing rollers 80, 82 and 84, it achieves the same advantage even with four or more developing rollers. The advantage discussed above is attainable even with the downstream developing roller 84 alone. Each of the upstream and intermediate developing rollers 80 and 82 will also play the expected role alone if slightly modified.

Figure 5:
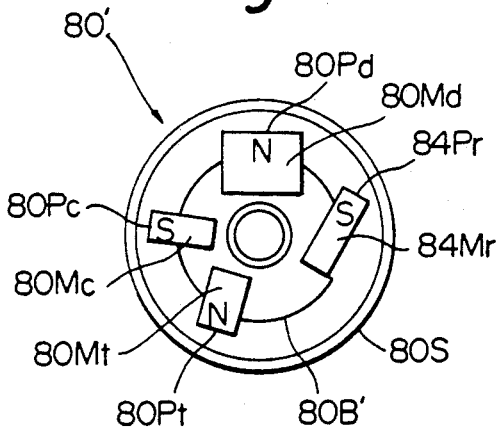
FIG. 5 is a section showing a modified form of the developing roller of FIG. 4.

FIG. 5 shows a modified form of the developing roller 80, FIG. 3. As shown, the modified roller 80′ may be regarded as the roller 80 to which the magnet 84M*r* with the collect pole 84 P*r* is added. Of course, the modified roller 80′ has the magnet 84M*r* with the collect pole 84P*r* dimensioned longer than the other magnets 80M*t*, 80M*c* and 80M*d* having the poles 80P*t*, 80P*c* and 80P*d*, although not shown in the figure. The magnets are mounted on the support member 80B′.

Figure 6:
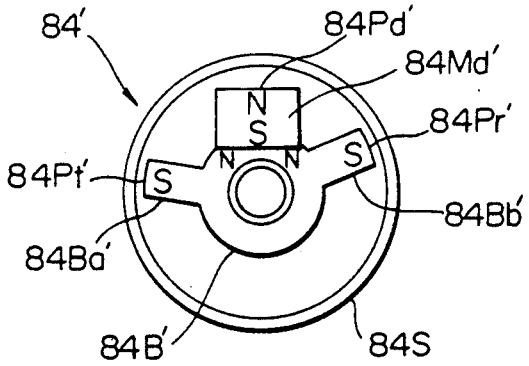
FIG. 6 is a section showing another modified form of the developing roller of FIG. 4.
Figure 7:
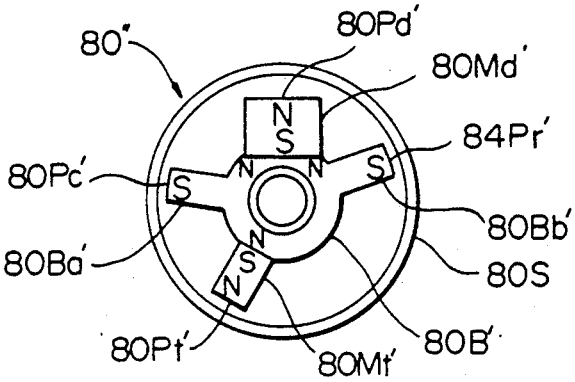
FIG. 7 is a section showing a modification of the developing roller shown in FIG. 5.

FIGS. 6 and 7 each shows a modification in which a support member is made of soft iron or similar magnetically highly conductive material in place of a non-magnetic material. Specifically, FIG. 6 shows a developing roller 84′ which is a modification of the roller 84. The roller 84′ has a develop pole 84P*d*′, implemented as the N pole. A support member 84B′ is sensitive to the S pole of the magnet 84M*d*′. A transport pole 84P*t*′ and a collect pole 84P*r*′ are implemented as the tips of arms 84B*a*′ and 84B*b*′ of the support member 84B′ which are magnetized to the N pole. FIG. 7 shows a developing roller 80″ which is a modified form of the developing roller 80′, FIG. 5. As shown, the developing roller 80″ has a develop pole 80P*d'* and a transport pole 80P*t'* which are implemented with the N poles of magnets 80M*d'* and 80M*t'*, respectively. A support member 80B' is sensitive to the S poles of the magnets 80M*d'* and 80M*t'*. The tips of arms 80B*a'* and 80B*b'* extending out from the support member 80B' are magnetized to the S pole to serve as a transport restrict pole 80P*c'* and a collect pole 84P*r'*, respectively. Again, in any of these modifications, the magnet having the collect pole 84P*r'* is longer than the magnets having the other poles. When the support member is made of a magnetically highly conductive material and alternating magnetic poles are implemented with arms of the support member and magnets, as stated above, miniature permanent magnets suffice since the magnetic resistance is reduced in the portions other than the portions where magnetic fields are developed in the space.

While the poles of the individual magnets have been shown and described as comprising N and S poles, the S and N poles may, of course, be replaced with each other. The single magnet with the collect pole and which is longer than the magnets with the other poles may be replaced with an array of short magnets arranged side by side in contact or at short intervals. This will also be successful in increasing the dimension of the effective magnetic field.

The foregoing description has concentrated on the specific application of the present invention to an electrophotographic copier. It will be apparent that the present invention is similarly practicable with any other type of image forming apparatus such as a laser printer or similar optical printer, high-speed facsimile transceiver, or digital copier.

In summary, it will be seen that the present invention provides a developing roller which, with a simple structure surely collects a developer of a magnet brush remaining thereon after development and thereby frees the interior of an image forming apparatus from contamination otherwise caused by the developer leaking from a developing unit.

Various modifications will become possible for those skilled in the art after receiving the teachings of the present disclosure without departing from the scope thereof.

What is claimed is:

1. A developing roller for a developing unit which develops a latent image electrostatically formed on an image carrier of an image forming apparatus by using a magnet brush constituted by a developer, said developing roller comprising:

a rotary sleeve for forming the magnet brush on a surface thereof and transporting said magnet brush to the image carrier carrying the latent image;

a transport magnet accommodated in said sleeve and comprising a transport pole;

a develop magnet accommodated in said sleeve and located downstream of said transport magnet with respect to an intended direction of rotation of said sleeve in such a manner as to face the latent image carried on the image carrier, and comprising a develop pole;

a collect magnet accommodated in said sleeve and located in a position downstream of said develop magnet with respect to said intended direction of rotation of said sleeve, and comprising a collect pole for collecting the developer of the magnet brush remaining on said sleeve into the developing unit; and a support member accommodated in said sleeve for securely supporting said transport magnet, said develop magnet, and said collect magnet;

said collect magnet being dimensioned longer than said transport magnet and said develop magnet as measured in an axial direction of said sleeve.

2. A developing roller as claimed in claim 1, further comprising a transport restrict magnet interposed between said transport magnet and said develop magnet and comprising a transport restrict pole for retaining the magnet brush on said sleeve.

3. A developing roller as claimed in claim 1, further comprising a shield plate located in close proximity to said collect magnet for weakening a magnetic field being developed by said collect magnet.

4. A developing roller as claimed in claim 1, wherein said sleeve and said support member each is made of a non-magnetic material.

5. A developing roller as claimed in claim 1, wherein said sleeve and said support member each are made of a non-magnetic material and a magnetically highly conductive material, respectively.

6. A developing roller for a developing unit which develops a latent image electrostatically formed on an image carrier of an image forming apparatus by using a magnet brush constituted by a developer, said developing roller comprising:

a rotary sleeve for forming the magnet brush on a surface thereof and transporting said magnet brush to the image carrier carrying the latent image;

a transport magnet accommodated in said sleeve and comprising a transport pole;

a develop magnet accommodated in said sleeve and located downstream of said transport magnet with respect to an intended director of rotation of said sleeve in such a manner as to face the latent image carried on the image carrier, and comprising a develop pole;

a collect magnet accommodated in said sleeve and located in a position downstream of said develop magnet with respect to said intended direction of rotation of said sleeve, and comprising a collect pole for collecting the developer of the magnet brush remaining on said sleeve into the developing unit; and a support member accommodated in said sleeve forming said transport magnet and said collect magnet and for securely supporting said develop magnet;

said collect magnet being dimensioned longer than said transport magnet and said develop magnet as measured in an axial direction of said sleeve.

* * * * *